US005906531A

United States Patent [19]

Llorens

[11] Patent Number: 5,906,531

[45] Date of Patent: May 25, 1999

[54] DOLL PROVIDED WITH MOVEMENT OF AN ARM AND HEAD

[76] Inventor: Jaime Ferri Llorens, Avenida de la Constitucion 22., 03430 ONIL (Alicante), Spain

[21] Appl. No.: 09/008,622

[22] Filed: Jan. 16, 1998

[30] Foreign Application Priority Data

Jan. 21, 1997 [ES] Spain ..... 9700107

[51] Int. Cl.[6] ..... A63H 3/20; A63H 3/36; A63H 3/46

[52] U.S. Cl. ..... 446/340; 446/338; 446/383

[58] Field of Search ..... 446/330, 337, 446/338, 339, 340, 341, 343, 345, 352, 376, 383, 381

[56] References Cited

U.S. PATENT DOCUMENTS

| | | | |
|---|---|---|---|
| 982,096 | 1/1911 | Schoenhut | 446/381 |
| 1,050,793 | 1/1913 | Beedle | 446/381 |
| 3,566,535 | 3/1971 | Handler et al. | 446/381 |
| 3,672,096 | 6/1972 | Johmann | 446/338 |
| 3,851,418 | 12/1974 | Barlow et al. | 446/338 |
| 4,188,746 | 2/1980 | Wolf | 446/338 X |
| 4,268,991 | 5/1981 | Cotey et al. | 446/383 X |
| 5,088,954 | 2/1992 | Terzian et al. | 446/338 X |
| 5,147,238 | 9/1992 | Kelley et al. | 446/338 X |

*Primary Examiner*—D. Neal Muir
*Attorney, Agent, or Firm*—Litman, Kraai & Brown, L.L.C.

[57] ABSTRACT

The doll has the peculiarity that the movement towards the right or towards the left of one of its arms carries with it the same movement of the head and also of the eyes. Likewise, the movement upwards or downwards of the arm carries with it the movement upwards and downwards of the head. Both movements can be made in combination, whereby any object (dummy, feeding bottle or similar) held in the hand of the driven arm, is carried towards the upper-front part, in such a way that if it is a feeding bottle this one is applied to the mouth of the doll and a miction of the doll is produced. Such movements are achieved as a consequence that the driven arm and the head are assembled on the body of the doll, through both ball joints, through a series of levers, axles and forks as so as to allow of transmission of the movements of a main lever associated to the ball joint of the arm, up to the ball joint itself of the head. FIG. 1.

6 Claims, 5 Drawing Sheets

DOLL PROVIDED WITH MOVEMENT OF AN ARM AND HEAD

BACKGROUND OF THE INVENTION

The invention relates to a doll provided with movement of an arm and head, which has been designed and made based on the independent movements, but with marked rhythm, of one of the arms and the doll head, this doll simulates natural movements such as putting the dummy into its mouth, making sound with the rattle, putting the feeding bottle into its mouth and drinking its content, in which case the doll simultaneously performs the urinating physiological function. Furthermore these movements are complemented with its eyes lateral movements.

Numerous types of dolls are known that perform different movements, starting up with walking to moving all the other members, including the head, and even to perform simultaneous jumping movements, etc.

In all the cases, the doll in question has a high cost, due to the fact that in order to produce the different movements highly complex mechanisms are required, both from the structural point of view as well as from the functional one.

It is also unknown the existence of dolls that perform simultaneous movements of an arm and the head, and that those movements are with marked rhythm in the same way as it is really in human bodies in order to perform the above mentioned functions.

More precisely the doll which is proposed has the peculiarity that one of its arms, precisely the left one, is assembled on the body of the doll through a ball joint which makes possible to perform both to the right as well as to the left movements, and both ascending as well as descending movement, of the -arm itself. Those movements are independent, although the user can perform the movements simultaneously.

The movements in question are achieved based on an articulated lever in the inside of the ball joint, which lever swivels towards the front and backwards driving a set of levers, axles and components, as well as a gear, in order to transmit the produced movement to the doll up to the head of the doll itself, being such head also assembled by means of a ball joint that can swivel, depending on the movement produced on the arm, towards the left side or towards the right side, or also upward or downward movements. Simultaneously to the movements of the doll's arm towards the right side or towards the left side, the movements of the eyes are also produced towards the right or towards the left, since the assembling means of such eyes are linked to a flexible axle which is driven with the means that produce the head movements.

Finally, it deals with a doll that when moving an arm in ascending/descending direction, it moves simultaneously the head upward or downward, respectively, and vice versa. Likewise, when moving the referred arm towards the right or towards the left, the head will be simultaneously moved towards the right or towards the left, and vice versa. In this movement, the eyes are moved in the same way, that is, towards the same side as the head.

The configuration and assembling of the arm which when moving are such, that having an accessory in its hands, for example, a feeding bottle, when rising the arm and turning the head, will place the feeding bottle in an opening located in the mouth, in such a way that if the user presses the feeding bottle the water or liquid contained in the feeding bottle passes into the doll, and through a flexible duct foreseen to this effect, reaches the urinary apparatus of the doll and the direct exit of the water or liquid is produced, in an action which simulates a real miction.

Likewise, the doll can hold with the hand of its movable arm, any other type of accessory, such as a dummy that will place near its mouth; being able also to hold a rattle and by means of movements of the arm the rattle will accompany those movements producing the corresponding sound.

In order to complete the description that is going to be carried out below and with the purpose of helping to a better understanding of the characteristics of the invention, a detailed description is going to be carried out based on a set of drawings which are accompanying this specification, forming an integral part thereof, and wherein by way of illustration and not by way of limitation the following has been represented:

DETAILED DESCRIPTION OF THE ILLUSTRATED EMBODIMENT

Figure 1:
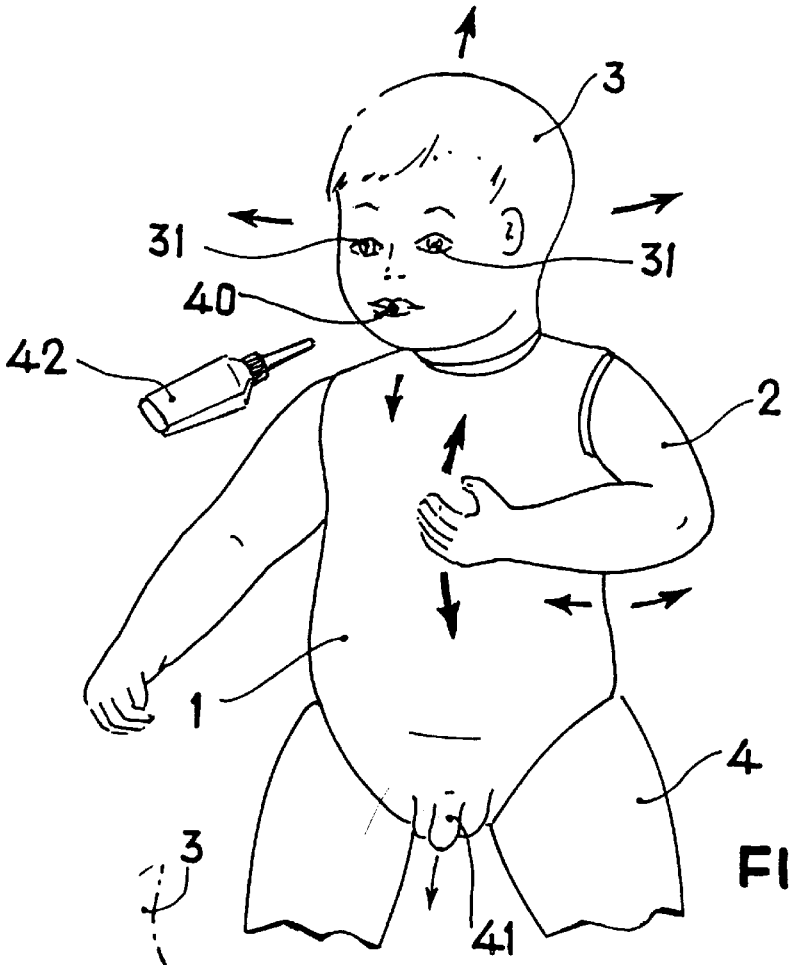
In FIG. 1, it is shown a frontal and partial view of the doll, representing the head, arms and body, as well as a feeding bottle. It is also represented the upper part of the legs and the indicating arrows of the movements that can perform the left arm and the head.
Figure 2:
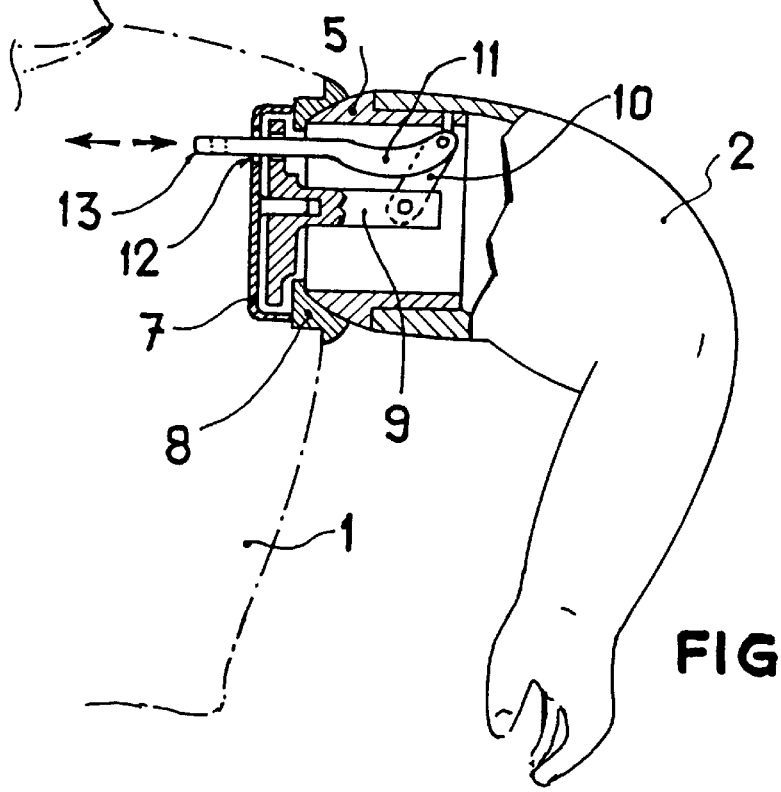
In FIG. 2 it is shown a detailed cross section of the assembling of the left arm on the doll body.
Figure 3:
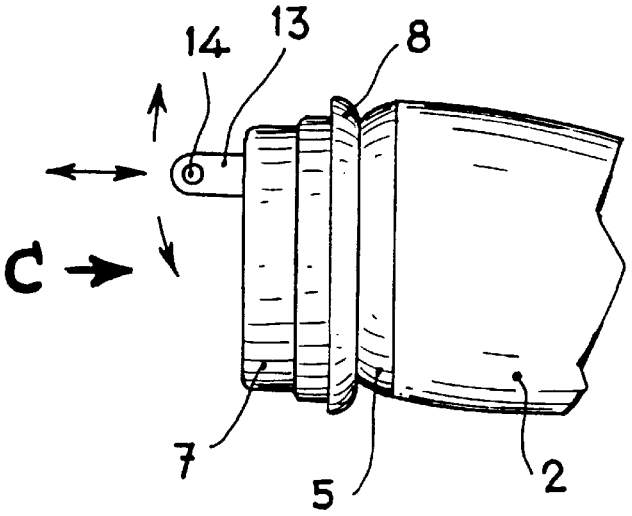
In FIG. 3, it is externally shown the coupling end part of the mentioned left arm.
Figure 4:
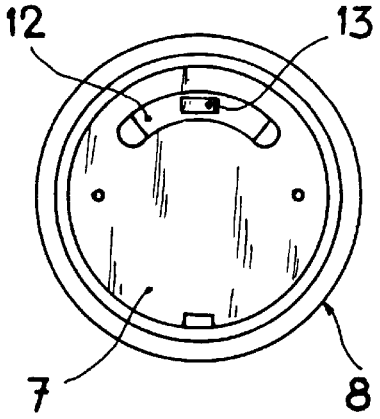
In FIG. 4, it is shown a view by C of the part represented in FIG. 3.
Figure 5:
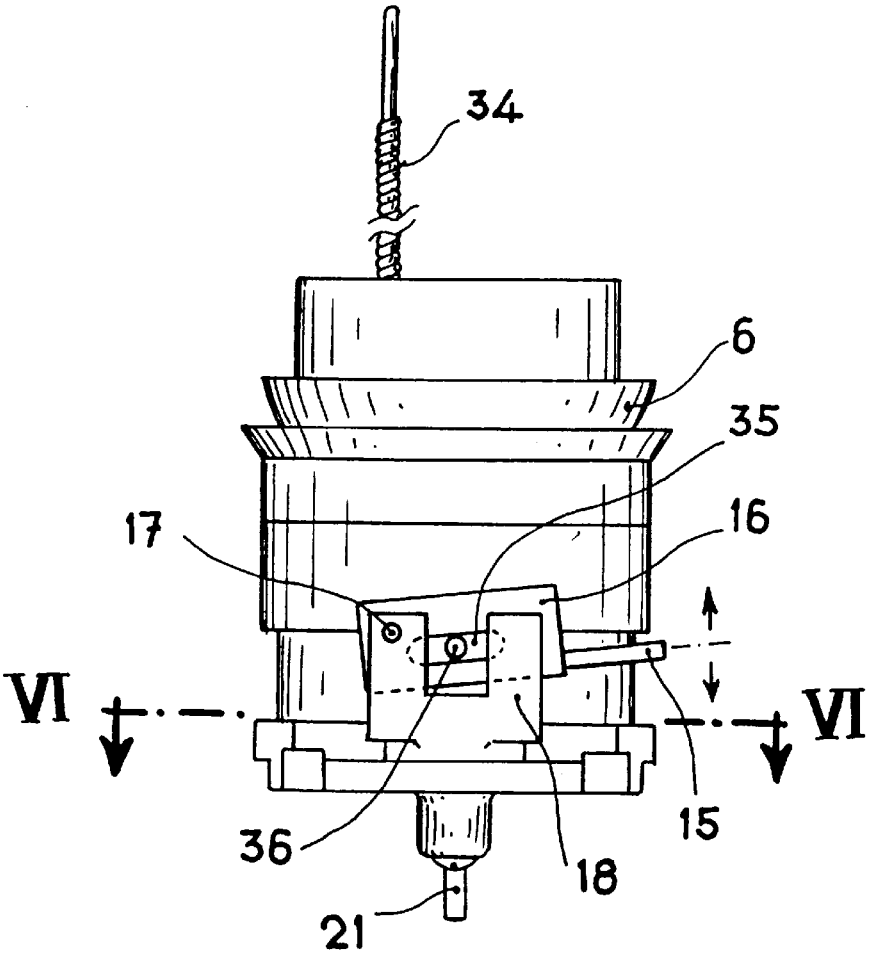
In FIG. 5, it is shown an external view of the mechanism section which is driven from the movements of the left hand, in order to produce the respective movements of the head.
Figure 6:
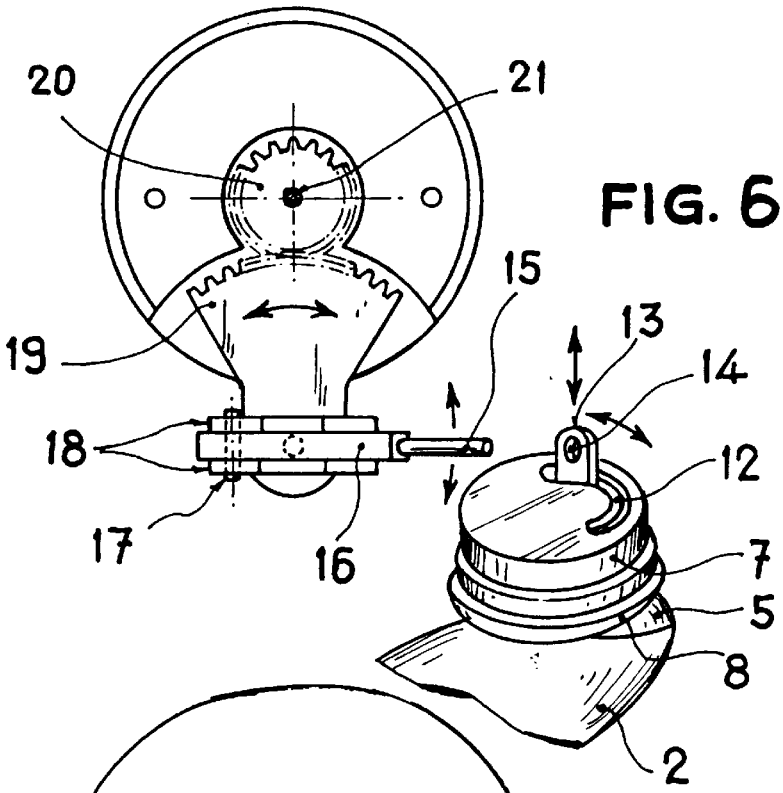
In FIG. 6, it is shown a plant view by VI—VI of FIG. 5, of the section of the mechanism represented in the previous figure, showing the gearing that takes part in such mechanism, and in exploded drawing the end part of the left arm from which the movement is transmitted to such mechanism.
Figure 7:
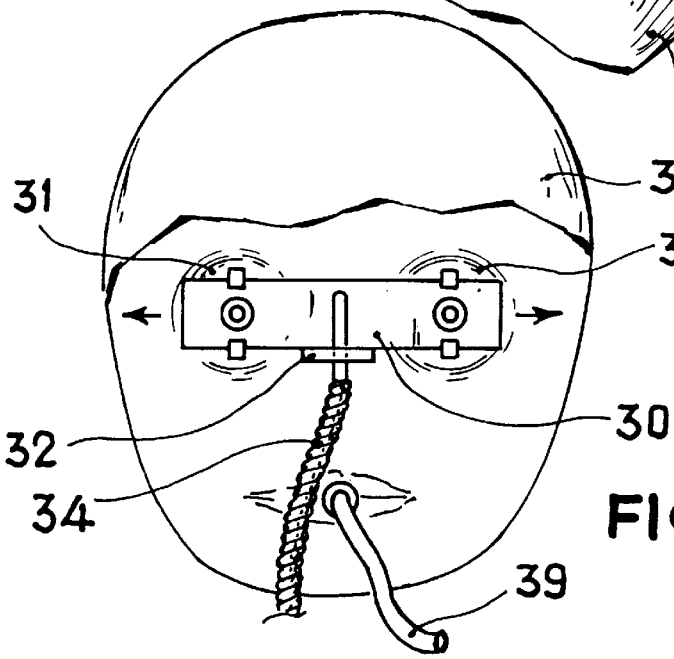
In FIG. 7, it is shown a frontal view of the detail corresponding to the way of transmitting the eyes movement.
Figure 8:
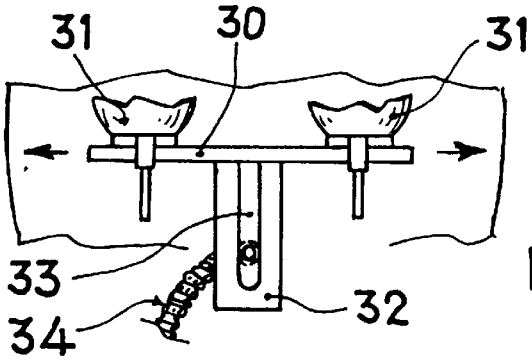
In FIG. 8, it is shown a plant view in detail of the previous figure.

As it can be seen in the mentioned figures, the doll (1) of the invention, with its corresponding arms (2), head (3) and legs (4), assembled on the trunk or body (1) itself, has the peculiarity that both, one of the arms (2), precisely and preferably the left one, as well as the head (3), are assembled to the body (1) through the respective ball joints (5) and (6).

The ball joint (5) corresponding to the arm (2) remains arranged between this one and a cup (7), with the insertion of a coupling annular component (8). To the cup (7) an arm (9) is internally fixed, forming an articulation means for the end of a driving lever (10) in which opposite end a main lever (11) is articulated which is passing through the bent groove (12) of the bottom of the cup (7), emerging an end section (13) of such main lever (11) to the inside of the body (1), of the doll, having in that end section (13) an opening (14), in which a lateral axle or pin (15) is located belonging to a prismatic and a swivel-mounted component (16), that near the opposite end of the pin (15) is assembled in an axle (17) transversely foreseen between the arms of a fork (18).

From the mentioned fork (18) jointly emerges an indented or gear toothed section (19) which gears with a pinion (20) assembled on an axle (21), which is passing through an axial bushing (22) complemented by an enveloping jacket (23) equipped with a lateral tailpiece (24).

Figure 9:
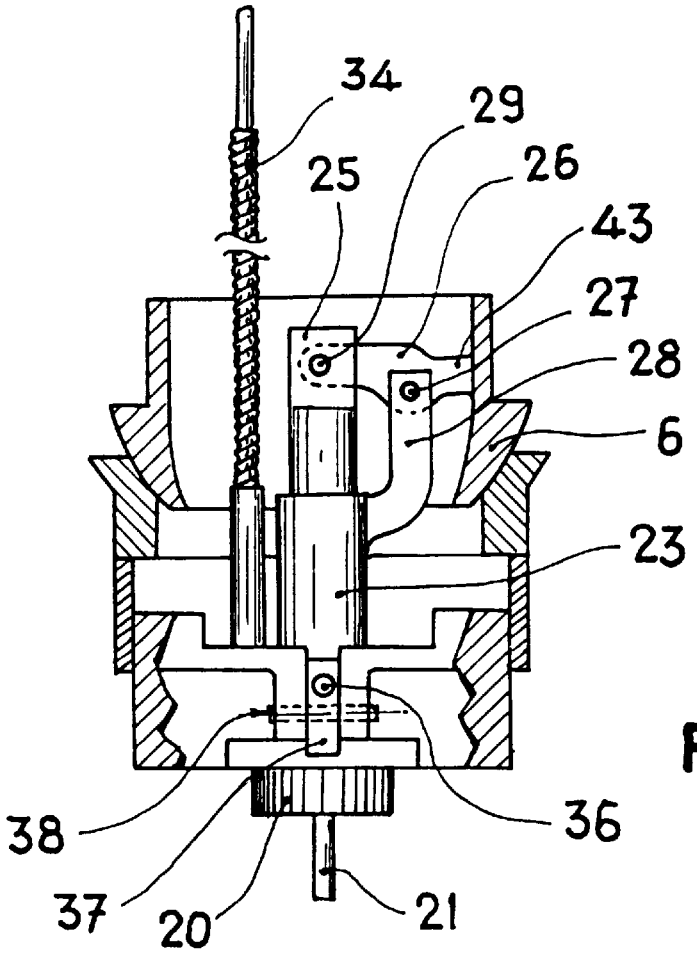
In FIG. 9, it is shown a cross section view of the section of the mechanism corresponding to FIG. 5, through which the movement towards the front and towards the back of the head is produced.
Figure 10:
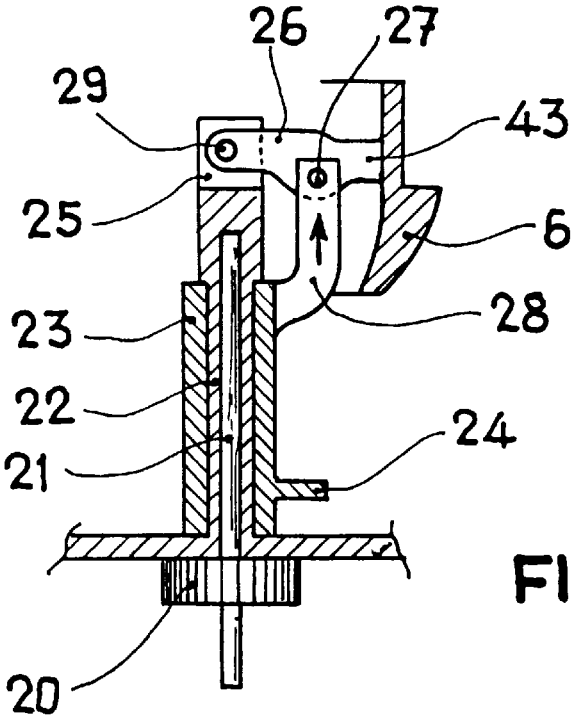
In FIG. 10, it is shown a cross section detail of a part corresponding to the mechanism assembly of the previous figure.
Figure 11:
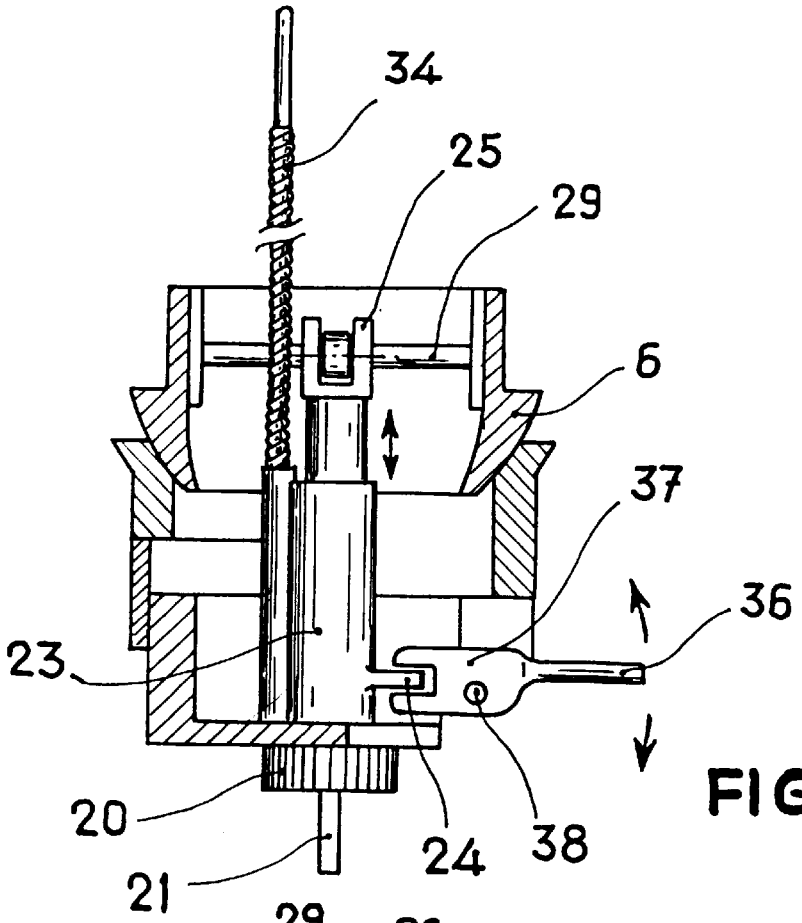
In FIG. 11, it is shown a turned view of the mechanism section of FIG. 9, also including a piece from which it is produced the ascending/descending movement of the head.
Figure 12:
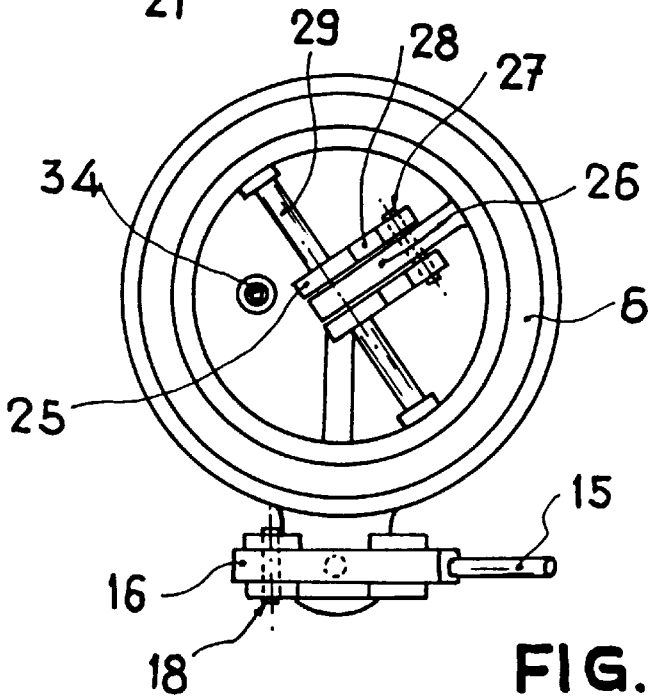
In FIG. 12, it is finally shown a detail in plan of the section of the mechanism represented in FIG. 5.

The axle (21) is jointly linked through its upper end to a fork (25), in which a lever (26) is articulated which in turn articulates in an axle (27) foreseen in a second fork (28), being this one jointly linked to the jacket (23). In FIG. 9, these elements can be clearly seen and the articulation (29) of the lever (26) to the fork (25); with the peculiarity that such articulation (29) is formed by an axle jointly linked by its ends to the ball joint (6) itself of the head (3), being foreseen that in the inside of this one is assembled, as it is logical, the corresponding support (30) of the eyes (31), support which has a transversal rectangular component (32) with a longitudinal window (33) in which a flexible axle or line (34) plays, all of it with a functionality which will be subsequently explained.

Going back to the prismatic swivel mounted component (16), it must be pointed out that it has a window (35) in which an axle or window following link (36) is housed belonging to a fork (37) between such arms is arranged the tailpiece (24) of the jacket (23), being this fork (37) assembled on a swivel mounted axle (38).

Finally, the doll includes inside a flexible duct (39) that communicates the mouth (40), with the urinary apparatus (41).

Based on the characteristics already mentioned, when a movement is performed towards the right side or towards the left side of the arm (2), the movement towards the right or towards the left of the head (3) is simultaneously produced. Likewise, if an upwards or downwards movement of the arm (2) is performed it is simultaneously produced the swivel movement upwards or downwards of the head (3).

Both types of movements can be performed at the same time, wherewith the hand of the arm (2) can come near or move away from the mouth of the doll, and in the case of holding this one, for example, a feeding bottle (42) a miction of the doll will be produced, since the water or liquid contained in such feeding bottle (42) will pass into the duct (39) and from this one to the urinary apparatus (41).

In the movement from right to left of the head (3); and vice versa, movements will also be produced in the same direction of the eyes (31).

The operation is as follows:

When the movement is produced towards the right side or the left side (coming near or moving away from the body) of the arm (2) through the ball joint (5) the movement will be transmitted to the main lever (11) and from this one to the component (16) which will swivel and will turn the indented section (19), wherewith the turning of the pinion (20) will be produced and therefore of the axle (21), transmitting the movement from this one to the lever (26) which is jointly linked by its end (43) to the ball joint (6) of the head, which will originate that such head turns to the right or to the left.

When producing the successive turns to the right or to the left of the head (3) of the doll (1) the flexible axle (34) will produce the displacement to one side or the other of the support (30), wherewith the eyes (31) foreseen in such support will move to one side or the other, that is, towards the right or towards the left, with the same movement of the head and of course of the arm (2).

If the arm (2) of the doll is moved upwards or downwards the swivel movement upwards or downwards of the main lever (11) and wherewith the swivel movement of the component (16) will be produced. This movement will be transmitted to the axle (36) of the fork (37) and therefore the elevation or lowering will be produced, precisely through such component (37) of the tailpiece (24) and with this one of the jacket (23) to which it belongs to. Such descending and ascending movements will be transmitted from the jacket (23) to the lever (26), producing the swivelling upwards and downwards of this one and thereof the ball joint (6), or what it is the same, of the head (3) of the doll (1).

I claim:

1. A doll provided with movement of an arm and head, the doll having a right side and a left side, the arm having movability towards at least one of the right side or the left side, as well as at least one of upwards movement and downwards movement, coordinating with the arm the same movements of the head and of eyes associated with the head when the movement of the arm is toward any side to which the arm has mobility, essentially characterized in that both the arm (2) as well as the head (3) are assembled on a body of the doll (1) through an arm ball joint (5) and a head ball joint (6) respectively so as to make possible movement between left and right and movement between upward and downward; linked to the arm ball joint (5) is a main lever (11) that is assembled in relation to and linked to a swivel component (16), through a pin (15), the pin (15) is articulated by a first axle (17) located on a first fork (18), the swivel component (16) carries a gear toothed section (19) which gears with a pinion (20) assembled on a second axle (21), jointly linked through an upper end of the second axle to a second fork (25), that in turn is pivotally linked to a third fork (28) through which arm movements are transmitted between right and left from the arm (2) to the head (3), to cause the head to perform these same movements between right and left.

2. Doll provided with movement of an arm and head, according to claim 1, characterized in that the swivel component (16) has a longitudinal window (35) in which plays a window following link (36) joined to a fourth fork (37), a lateral tailpiece (24) is joined to a jacket (23) enveloping a bushing (22) axially receiving the axle (21), in such a way that when the arm (2), moves either upward or downward a swivel movement is produced in the main lever (11) that is transmitted to the fourth fork (37), producing upwards or downwards swivelling of the fourth fork, the fourth fork (37) is slideably mounted on the tailpiece (24) and produces corresponding upwards or downwards movement of the tailpiece (24) of the jacket (23), which then produces corresponding movement of a lever (26) that is linked to the head ball joint (6) so as to produce an associated movement of the head towards the front or rear.

3. A doll provided with movement of an arm and head, according to claim 1, characterized in that a cup (7) is positioned between the arm (2) and a body of the doll (1), the cup (7) is linked to an axial and internal arm (9); a driven lever (10) is articulated at one end to the internal arm (9) and at an opposite end to the main level (11); the main lever (11) has a free end opposite whereat the main lever articulates with the driven lever that has an opening (14) in which the pin (15) of the swivel component (16) is housed.

4. Doll provided with the movement of an arm and head, according to claim 2, characterized in that the lever (26) is pivotally linked through a first articulated end (29) to the second fork (25) and through the second fork (25) to an upper end of the vertical axle (21), the lever 26 having a second end (43) linked to the head ball joint (6) the third fork (28) is linked to a lateral surface of the jacket (23) and pivotally connected to the lever 26.

5. Doll provided with movement of an arm and head, according to claim 1, characterized in that the doll includes a flexible link (34) that plays in a window (33) of a corresponding support (30) so as to be connected to the support (30), the support (30) is linked to eyes (31) of the doll (1), the flexible link (34) is joined to the body of the doll (1) opposite the connection of the flexible link (34) to the support (30); the eyes (31) are moveable from side to side such that as the head moves from side to side, the flexible link (34) holds the support (30) in position relative to the body of the doll causing the eyes (31) to move relative to the head thereby producing a movement between right and left in the eyes (31) relative to the head.

6. Doll provided with movement of an arm and head, according to claim 1, characterized in that the doll includes a flexible duct (39) arranged between a mouth (40) and an urinary apparatus (41) of the doll (1), so as to functionally allow the miction of the doll through the duct (39) when the arm (2) applies a feeding bottle (42) to the mouth (40).

* * * * *